United States Patent [19]

Johansson et al.

[11] 4,109,806

[45] Aug. 29, 1978

[54] DEVICE FOR MOVING RAILWAY WAGGONS

[75] Inventors: Anders Johannson, Bohus Björkö; Per Strömbeck, Lindome, both of Sweden

[73] Assignee: Salen & Wicander Terminalsystem AB, Gothenburg, Sweden

[21] Appl. No.: 772,244

[22] Filed: Feb. 25, 1977

[30] Foreign Application Priority Data

Feb. 27, 1976 [SE] Sweden ..... 7602613

[51] Int. Cl.[2] ..... B60P 1/16; B65G 67/02

[52] U.S. Cl. ..... 214/38 CC; 214/515; 214/621

[58] Field of Search ..... 214/14, 16 B, 38 C, 214/38 CA, 38 CC, 38 D, 515, 621; 104/1 R, 29, 31, 48–50, 88, 127–129

[56] References Cited

U.S. PATENT DOCUMENTS

| | | | |
|---|---|---|---|
| 2,976,817 | 3/1961 | Stapp | 104/48 X |
| 3,669,292 | 6/1972 | Tuura | 214/38 CC X |

*Primary Examiner*—Robert G. Sheridan

*Attorney, Agent, or Firm*—Cantor and Singer

[57] ABSTRACT

A framework carrier adapted to move railway waggons outside a railway yard includes two first, longitudinal beams, each carrying a rail and two second, transverse beams adapted to co-operate with a transporting member, said transverse beams being adapted to locate the rails upon the carrier in alignment with the rails of the tracks, when the carrier is brought to rest against fixed stops at the track heads.

5 Claims, 7 Drawing Figures

DEVICE FOR MOVING RAILWAY WAGGONS

CROSS-REFERENCE TO RELATED APPLICATION

Reference is made to our related co-pending application Ser. No. 772,243 for "A Method of Transhipping General Cargo Between Wheeled Carriages and Ship, and a Plant for Working This Method", filed on even date herewith, now U.S. Pat. No. 4,090,620.

BACKGROUND OF THE INVENTION

On many occasions it is desirable to move a loaded railway waggon from a railway yard to a place of unloading, or from such a place back to the yard. For performing such movements specially designed trucks have been used, which are expensive and furthermore are difficult to bring into proper position with respect to the rail heads.

A device for moving railway waggons outside a railway yard may include a framework carrier adapted for co-operation with a transporting member, and having a length corresponding to the length of a railway waggon, and means for locking the waggon to the carrier.

According to the invention it is now proposed that the framework carrier includes two first, longitudinal beams, each carrying a length of rail and located at a mutual distance locating said lengths of rail at normal track gauge, as well as two second, transverse beams adapted to co-operate with the transporting member, and having a length suited, when brought into contact with fixed stops at the track heads, to locate the lengths of rail in alignment with the rails of the track. The means for locking the waggon to the carrier may advantageously include braking blocks, pivotably connected to the carrier, and adapted for co-operation with the wheels of the waggon, as well as a spring loaded linkage, adapted normally to maintain the braking blocks in engaged position, means being provided within the pocket for actuating the linkage towards releasing position.

DESCRIPTION OF A PREFERRED EMBODIMENT

Figure 1:
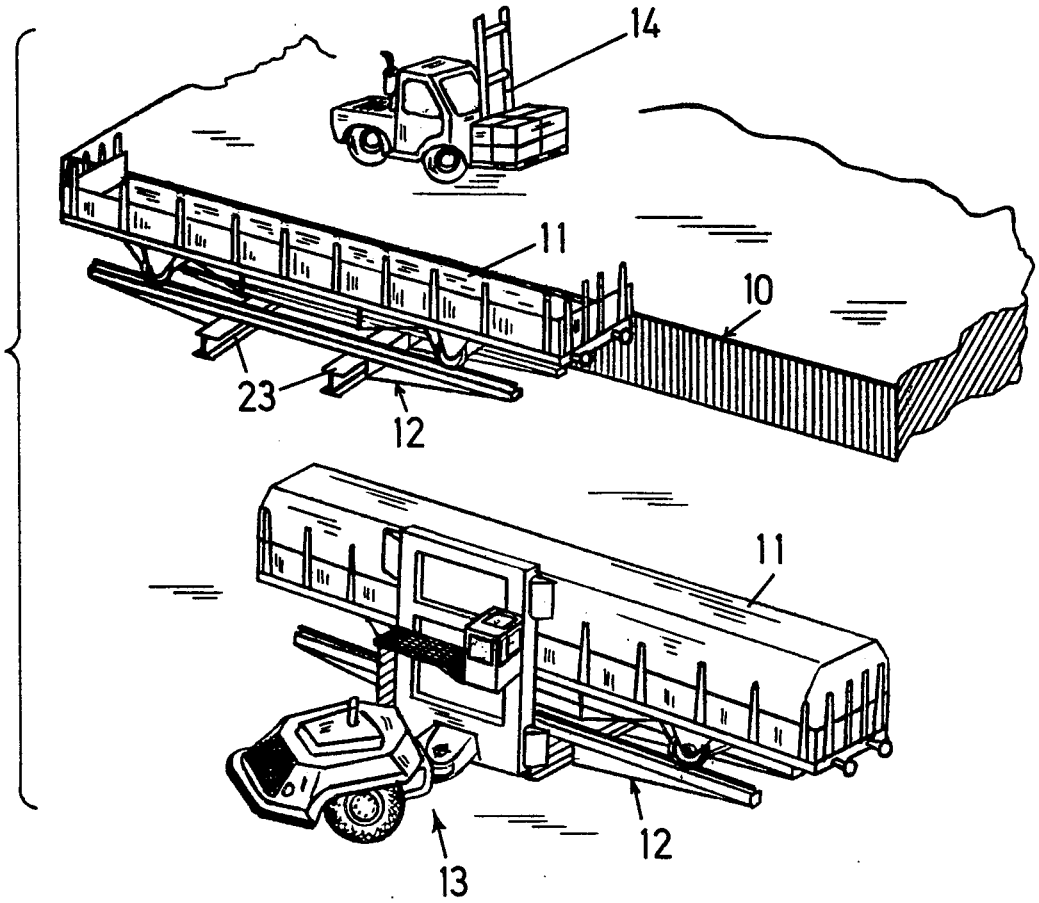
FIG. 1 is a perspective view of a loading platform, located at some distance from a railway yard, but providing facilities for directly loading and unloading railway waggons.

A loading platform is in FIG. 1 generally denoted by reference 10, and may be a transhipping magazine, or a distribution center, where it is desirable to move goods directly to or from railway waggons 11, but where it, for certain reasons is not feasible to extend the tracks to the platform.

Railway waggons are therefore moved between the platform and the tracks, not shown in FIG. 1, resting on carriers 12. These are adapted for co-operation with transport devices 13, including a low trolley, which may be pushed in below a carrier, and, for instance by means of built-in hydraulic rams, may lift the carrier with the waggon resting thereon for moving it along the ground. Transport upon the platform is performed by means of fork-lift trucks 14, or other suitable means.

Figure 2:
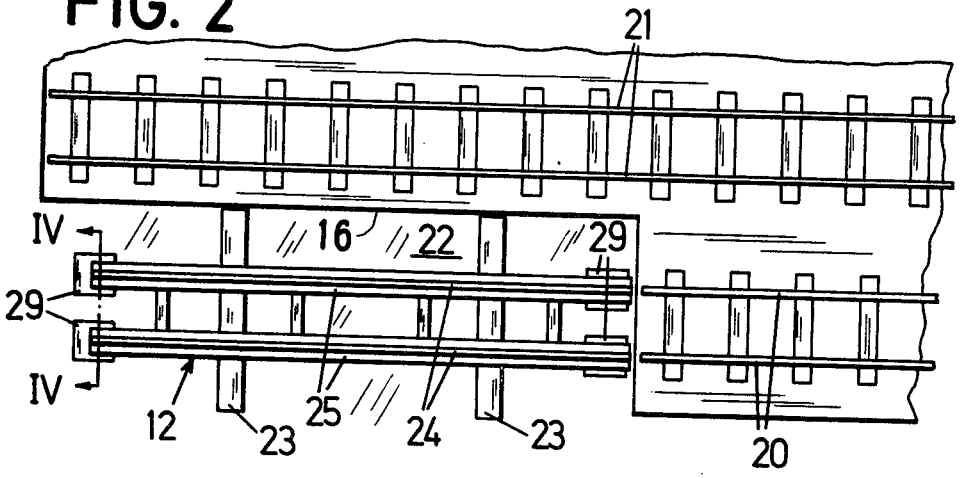
FIG. 2 is a plan view of part of a railway yard, with a carrier fitted at one railway head.

FIG. 2 shows part of a railway yard, viz: the heads of two railway tracks 20 and 21.

In order to make possible a rational loading and unloading of the railway waggons it is desirable to have several waggons at hand at the terminal parts of a number of parallel tracks. Each railway head ends up at a pocket 22, forming part of a stepwise pattern, where the pockets have about the length of a railway waggon. Each pocket must have a vertical depth, as will be explained herebelow. The waggons will, in turn, be fed along tracks 20, 21, and will be received by carriers 12 for transportation to platform 10.

A carrier 12 includes, as main components two beams 23, preferably I-beams, arranged transversely with respect to the main direction of the railway tracks, and furthermore two primary beams 25, resting on the first-mentioned beams. The primary beams carry lengths 24 of railway rails, and the carrier has, as above mentioned, the same length as a railway waggon. Beside these members the carrier will of course include stays and brackets to form a strong and rigid unit.

Figure 7:
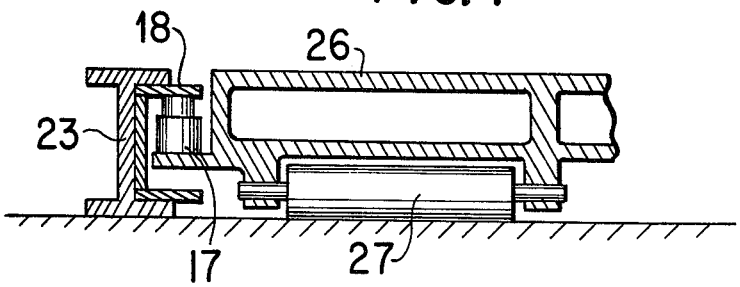
FIG. 7 is a sectional view, enlarged and partially fragmentary of a portion of the elevation of FIG. 3.
Figure 3:
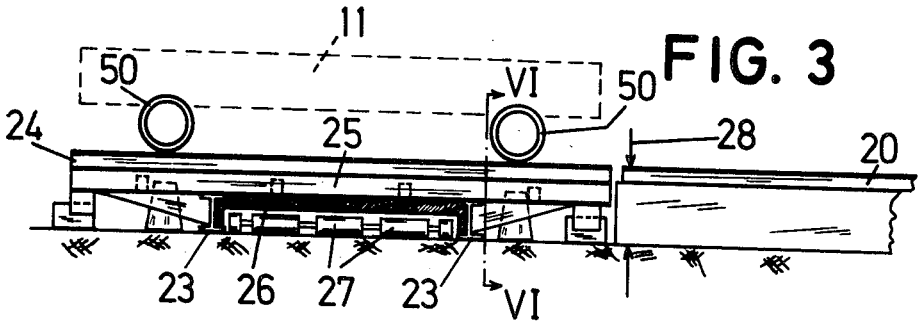
FIG. 3 shows an elevation of the view shown in FIG. 2.

The transverse beams 23 are so long, that they, when a carrier is brought into a pocket 22 until said beams abut the longitudinal wall 16 of the pocket which acts as a fixed stop and locates the ends of the lengths 24 of rails in alignment with the rails of a railway track, here 20. A trolley 26 forming part of the transport member 13, used for lifting and moving the carrier, is in FIG. 3 schematically shown below the latter. By means of hydraulic rams 17, shown in FIG. 7, the superstructure 18 of the trolley may be lifted with respect to wheels 27, and will then take up the load at beams 23, as well as at the intermediate portions of beams 25.

It is evident that the ends of the rails in line 20 must be located at a distance, 28, above the ground corresponding to the height of the carrier so a railway waggon may be moved directly from the line to the carrier.

In order to facilitate the handling of goods at platform 10, the level thereof should be located at a height, above the adjoining ground, corresponding to the distance from the base of the carrier to the floor of a waggon resting on the carrier.

Figure 4:
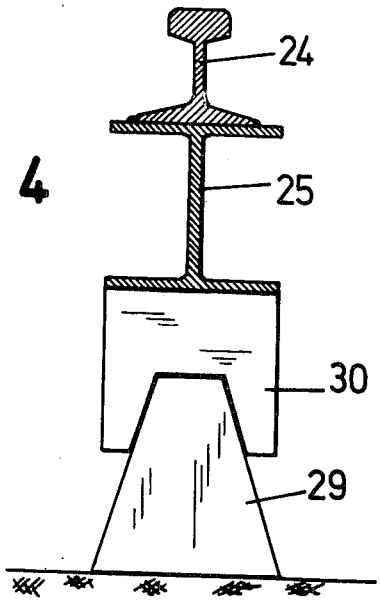
FIG. 4 shows a detail of a section along line IV—IV in FIG. 2.

To prevent the ends of beam 25 from being forced downwards, when a waggon is moved to and from carrier 12, the pocket is provided with four abutments 29 upon which the ends of the beams rest, when the carrier is located in the pocket. As is shown in FIG. 4, each abutment is wedge-formed and adapted to co-operate with guides 30 at the longitudinal beams, for bringing the lengths 24 of rails into direct alignment with the rails of track 20.

Figure 5:
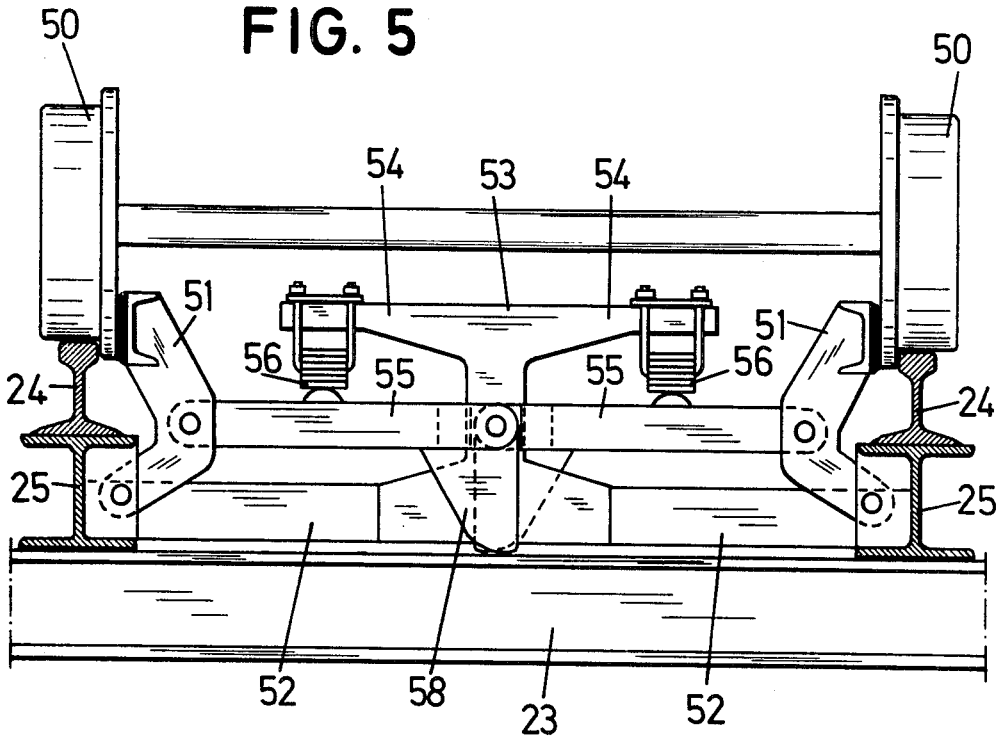
FIG. 5 shows a detail of the blocking system, in its active position during transportation.
Figure 6:
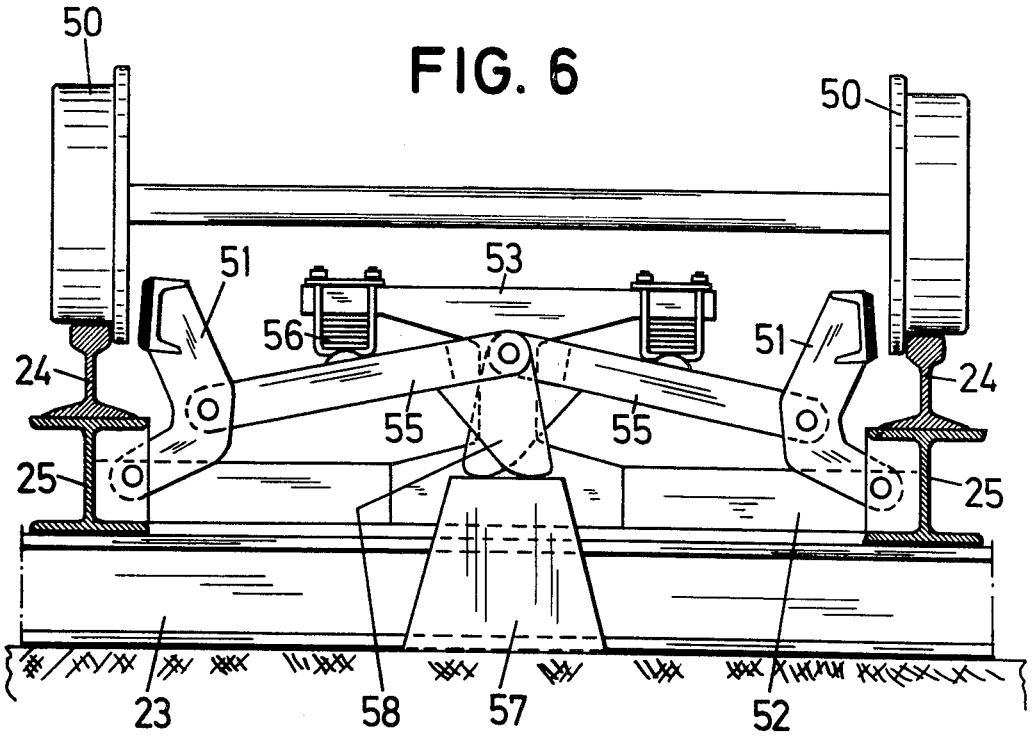
FIG. 6 shows the same view of the blocking system, when the carrier has been brought to the position shown in FIG. 2, for receiving a railway waggon.

It is of course essential that the waggon be securely retained at the carrier during movements thereof to and from the railway tracks. A suitable blocking means is shown in FIGS. 5 and 6.

For each pair of wheels 50, or for each boggie, at the waggon a blocking device is provided at the carrier.

Each blocking device includes two brake blocks 51, which are pivotably mounted at the longitudinal beams 25 of the carrier. Between these beams there is a support structure 52, carrying a central yoke device 53. This provides a central post and two arms 54, extending transversely from its stop part, reaching towards wheels 50.

Two links 55, being pivotably interconnected, are pivotably connected to brake blocks 51. These links have a considerable extension in the longitudinal direction of the carrier, and the post of the yoke device extends through mating openings in the links.

Packages of leaf springs 56 are fitted between arms 54 and links 55, and will normally maintain the latter in the position shown in FIG. 5, in which the brake blocks 51 are forced against wheels 50.

Within pocket 22 plinths 57 are mounted in position suited for co-operation with cam members 58 at the inward ends of links 55. When a carrier is brought into a pocket and is lowered to the ground plinths 57 will force links 55 to the position shown in FIG. 6, whereby the brake blocks are released from the wheels. Plinths 57 are provided within pockets 22 only, and in all other positions, thus also at platform 10, the waggon is securely retained at the carrier.

The embodiment above shown and described must be regarded as an example only, and must not be interpreted as limiting the invention. The design of the components forming part of the illustrated device may be modified in many ways within the scope of the appended claims.

What I claim is:

1. A device for moving a railway waggon outside a railway yard where tracks terminate blindly at track heads which define a pocket and include a fixed stop, comprising (a) a framework carrier having a length corresponding to about the length of a railway waggon, (b) a detachable transporting member for moving said carrier along the ground, outside the yard, said transporting member having a superstructure which engages said transverse beams, supporting wheel means, and means for raising and lowering said superstructure with respect to said wheel means, (c) said carrier including a pair of transverse beams adapted for co-operation with said transporting member, a pair of longitudinal beams carried on said transverse beams and spaced apart at normal track gauge, and a length of rail on each said longitudinal beam, (d) said transverse beams having projecting portions adapted, when brought into contact with the fixed stop at the track head, to position said lengths of rails into alignment with rails at a track.

2. The device according to claim 1, further including fixed abutments located at the track heads, and adapted to carry the ends of said longitudinal beams, when a railway waggon is moved to or from the carrier, and further exactly to position said lengths of rails in alignment with the rails of the track.

3. The device according to claim 1, in which the means for locking the waggon to the carrier includes braking blocks, pivotably connected to the carrier, and adapted for co-operation with the wheels of the waggon, as well as a spring loaded linkage, adapted normally to maintain the braking blocks in engaged position, and means at the track heads for actuating the linkage towards releasing position.

4. The device according to claim 3, in which a bracket is mounted on the center line of said carrier and each linkage for braking a pair of wheels includes two oppositely directed links pivotably connected to said bracket, and supporting spring means acting upon each link, each of said links being provided with a downwardly directed cam member, adapted to co-operate with said actuating means, which is formed as a plinth within the track head.

5. A plant for handling railway waggons outside a railway yard, comprising (a) a number of parallel tracks, each track being terminated at a track head formed as a pocket, said pockets being arranged in a stepwise pattern, where a pocket is defined by a transverse wall, having a length about corresponding to the breadth of a railway waggon, and a longitudinal wall, having about the length of a railway waggon, (b) a number of framework carriers, each having a length about corresponding to the length of a railway waggon, (c) at least one detachable transporting member for moving said carriers along the ground, outside the yard, said transporting member having a superstructure which engages said transverse beams, supporting wheel means, and means for raising and lowering said superstructure with respect to said wheel means, (d) said carrier including two first, longitudinal beams, a length of rail on each said beam and two second, transverse beams adapted for co-operation with said transporting member, and locating said first beams at a mutual distance for positioning said rails at normal track gauge, and (e) projecting portions at said transverse beams being adapted, when brought into contact with a longitudinal wall of one of said pockets to position said tracks into alignment with rails at the track, ending at said head.

* * * * *